United States Patent [19]

Barulich

[11] 4,350,342

[45] Sep. 21, 1982

[54] WORD GAME APPARATUS

[76] Inventor: Thomas J. Barulich, R.D. 1, Box 8G, Wawayanda Ave., Slate Hill, N.Y. 10973

[21] Appl. No.: 141,893

[22] Filed: Apr. 21, 1980

[51] Int. Cl.[3] ..... A63F 3/00

[52] U.S. Cl. ..... 273/240; 273/272; 273/138 A

[58] Field of Search ..... 273/272, 240, 299, 237, 273/138 A

[56] References Cited

U.S. PATENT DOCUMENTS

| | | | |
|---|---|---|---|
| 979,642 | 12/1910 | Bumstead | 273/299 |
| 1,061,999 | 5/1913 | Grondahl | 273/269 |
| 2,380,106 | 7/1945 | Hilton | 273/272 X |
| 3,393,914 | 7/1968 | Hill | 273/272 |
| 3,565,439 | 2/1971 | Krouse et al. | 273/272 |
| 3,606,336 | 9/1971 | Krause | 273/272 |
| 4,040,629 | 8/1977 | Kelly | 273/237 X |

*Primary Examiner*—Anton O. Oechsle
*Attorney, Agent, or Firm*—Ronald S. Cornell

[57] ABSTRACT

A word game apparatus is disclosed which comprises a first supply means with letters and a second supply means with letters separate from each other. The individual letters in each supply means are assigned a specific number value which forms a part of the player's score. Each supply means contains a full complement of all of the letters of the alphabet, and certain letters are provided in plural numbers. Each supply means contains an equal number of possible letter selections, however, the number frequency of a given letter in each supply means differs between the respective supplies. The first and second letter supply means may comprise containers such as bags or the like. To play the game, each player makes a first random letter selection from the first supply means, chooses a letter directly from the alphabet, and then makes a second random selection from the second supply means. At this point, the player must form a word and may add letters directly from the alphabet to do so. Points are determined by a series of numbers previously assigned to each of the letters of the alphabet and the formation of a word of eight letters, or other predetermined maximum, doubles the total points for that word. The winner is the player accumulating either the largest total points for a given number of rounds, or the first player to exceed a predetermined winning total. A specific scoring sheet is included which among other things provides the point values for each of the letters.

11 Claims, 4 Drawing Figures

COWOGA

PLAYER _____ WINNING SCORE _____

| | | | | | | | | |
|---|---|---|---|---|---|---|---|---|
| A=1 | B=2 | C=2 | D=2 | E=1 | F=2 | G=5 | H=4 | I=1 |
| J=6 | K=6 | L=4 | M=2 | N=3 | O=1 | P=2 | Q=9 | R=2 |
| S=2 | T=2 | U=1 | V=7 | W=8 | X=9 | Y=3 | Z=9 | |

8 LETTER WORDS SCORE DOUBLE

| TURN | WORD | LETTER SCORE | WORD SCORE | TOTAL SCORE |
|---|---|---|---|---|
| 1 | | | | |
| 2 | | | | |
| 3 | | | | |
| 4 | | | | |
| 5 | | | | |
| 6 | | | | |
| 7 | | | | |
| 8 | | | | |
| 9 | | | | |
| 10 | | | | |

COWOGA

PLAYER _____ WINNING SCORE _____

| | | | | | | | | |
|---|---|---|---|---|---|---|---|---|
| A=1 | B=2 | C=2 | D=2 | E=1 | F=2 | G=5 | H=4 | I=1 |
| J=6 | K=6 | L=4 | M=2 | N=3 | O=1 | P=2 | Q=9 | R=2 |
| S=2 | T=2 | U=1 | V=7 | W=8 | X=9 | Y=3 | Z=9 | |

8 LETTER WORDS SCORE DOUBLE

| TURN | WORD | LETTER SCORE | WORD SCORE | TOTAL SCORE |
|---|---|---|---|---|
| 1 | | | | |
| 2 | | | | |
| 3 | | | | |
| 4 | | | | |
| 5 | | | | |
| 6 | | | | |
| 7 | | | | |
| 8 | | | | |
| 9 | | | | |
| 10 | | | | |

FIGURE 1

WORD GAME APPARATUS

BACKGROUND OF THE INVENTION

The present invention relates to a word forming game apparatus. Word forming game apparatus are well known and have been developed in many variations throughout the years. The most well known apparatus is identified commercially by the trademark "SCRABBLE" and comprises a game board, a plurality of letters of the alphabet, each letter having a specified numerical value, and a support for the letters or tiles. The game is played from a single letter supply from which each player selects a specified number of letters and must in alternate fashion form words therefrom. The players are restricted to the letters selected in terms of the words that may be formed.

Similarly the following U.S. patents have been noted which in general disclose a variety of word forming games and related apparatus, all of which employ a predetermined number of letters from which each player must make specific selection, and thereafter attempt to form words, either by the formation of independent words or by the addition of letters to words already formed either previously by that player, or by one or more of the other players.

In particular, the patents noted are as follows:

U.S. Pat. No. 3,655,195 to Bean et al.; U.S. Pat. No. 3,524,648 to Nilan; U.S. Pat. No. 3,396,972 to Smith; U.S. Pat. No. 3,195,893 to Friedman et al.; U.S. Pat. No. 1,553,835 to Peters; and British Pat. No. 775,170 to Kemp.

In addition, the advent of micro electronics and computers has produced certain electronic games which simulate the functions of those earlier board games as above mentioned. For example, U.S. Pat. No. 3,982,764 to Diebold discloses a game of chance which includes as one of its variations a random formation of letters by the manipulation of electric switches and lights on a panel. In accordance with this invention each player takes turns randomly actuating lights in an attempt to form letters on a display from combinations of the lights. The first to assemble the lights into sufficient letters to form three words, wins the game.

All of these games are similar in that they restrict the mode of a play to a predetermined selection from materials or information forming a part of the game playing apparatus. The present invention seeks to promote a game that relies in part upon the guidance and structure of the game apparatus but permits the individual player to exercise individual imagination in playing the game.

SUMMARY OF THE INVENTION

In accordance with the present invention, a word game apparatus is disclosed which comprises a first supply means of letters and a second supply means of letters separate from each other. Each of the letters in the respective letter supply means are assigned a specific number value which contributes to the player's score. Each supply means contains a full complement of all of the letters of the alphabet, and certain letters are provided in plural numbers. Each supply means may contain an equal number of possible letter selections, however, the number frequency of a given letter in each supply means differs.

In one embodiment, the first and second supply means each comprises a container such as a cloth bag, or the like, and the individual letter selections may comprise tiles or blocks. In this embodiment, the tiles or blocks of the first supply means may be distinguished from those of the second supply means by alternate coloration in background and lettering.

Each of the letter supply means may contain an equal number of letter selections, including certain blank selections, if desired. In one embodiment, each letter supply means contains fifty (50) such selections including all of the letters of the alphabet distributed in multiples as to certain letters. The first and second letter supply means differ from each other in the exact multiples of each respective letter contained therein.

In addition to the first and second letter supply means, the present apparatus includes means on which information can be kept. For example, in one embodiment there is provided a plurality of individual scoring pads each containing sheets that provide information as to the point values of each of the letters of the alphabet, and individual line spaces for the words created by the player and their respective point score totals. Optionally, a timing device, such as an hour glass or the like may be included, for use when the game is to be played with time limitations imposed on each turn taken by the respective players. In this connection, the determination of the winner of the game may be made according to either the achievement of a predetermined total of points by one particular player, or the achievement of point superiority by a particular player after a predetermined number of rounds, where a round is defined as a turn by each player.

The game is played by permitting each player to take a full turn comprising making a first random selection of a letter from the first letter supply means, then selecting a second letter directly from the alphabet, and thereafter making a second random letter selection from the second letter supply means. At this point, the player must form a word with the letters selected, and may if necessary select additional letters directly from the alphabet. In the instance where a time limit is imposed upon each turn, the time begins to run as soon as the player completes the second random letter selection.

The present game apparatus may comprise a self contained computer equipped to store the separate letter supplies. In this embodiment, the computer receives a request from the player and provides a first randomly chosen letter. The player then selects a second letter directly from the alphabet, and then signals the computer again, whereupon a second letter is randomly chosen from the second letter supply stored within the computer's memory. At this point the game proceeds as described above and the player must proceed to form a word.

Accordingly, it is a principal object of the present invention to provide a word game whereby one or more players may participate to create words from letters selected only in part from a predetermined letter supply.

It is a further object of the present invention to provide a game as aforesaid wherein each player may create a word from a minimum of three (3) letters, two of which have been randomly selected.

It is a further object of the present invention to provide a game as aforesaid which employs two separate letter supply means.

It is a yet further object of the present invention to provide a game as aforesaid which may be played in a variety of ways, both manually and through operation of a computer.

Other objects and advantages will become apparent to those skilled in the art from a consideration of the ensuing specification which proceeds with reference to the following illustrative drawing.

BRIEF DESCRIPTION OF THE DRAWING

FIG. 1 comprises a plan view of a scoring sheet useful in accordance with the present invention.

DETAILED DESCRIPTION OF THE INVENTION

The present invention relates to a word forming game utilizing a game apparatus comprising first and second letter supply means. Each letter supply means contains a full complement of the letters of the alphabet, and further includes certain of the letters in multiple distribution. In a preferred embodiment, each of the letter supplies contains an equal number of letter selections, and the second supply means includes non-letter selections, the utility of which will be described with reference to the rules of the game discussed later herein.

Figure 2:
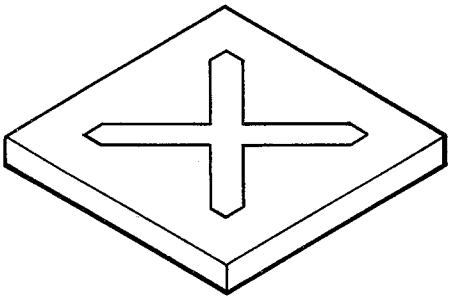
FIG. 2 comprises a perspective view of an illustrative letter selection made in accordance with the invention.

Each of the letters of the alphabet is assigned a numerical point value in accordance with this game. In one embodiment of this invention, the letters provided in the first and second letter supply means may assume the tangible form of tiles or blocks, in the manner similar to the word games already known in the art (see FIG. 2). Thus, the tiles or blocks may display prominently on one or more surfaces thereof the specific letter, and, in less prominent fashion if desired, the numerical value or point value thereof. The exact configuration of such tiles or blocks is immaterial and may be determined in accordance with the skill of the art. Thus, the tiles or blocks may assume the shape of discs, squares, triangles or the like, and the invention is accordingly not limited in scope to a particular configuration.

Figure 3:
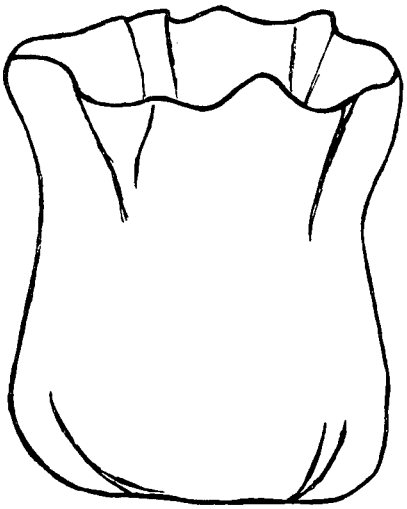
FIG. 3 is a perspective view illustrating the supply means of the invention.

In the instance where the first and second letter supplies assume tangible form, each supply means advantageously comprises a container within which are disposed the respective tiles or blocks. Further, the first and second letter supplies may be distinguished from each other by coloration; that is, for example, the first letter supply may be disposed in a black container or bag (see FIG. 3), and the tiles may present a black background on which white lettering and numbering is placed. The second letter supply may employ an opposite coloration, with a white bag and blocks or tiles having a white background with black lettering and numbering thereon. The particular colors, as well as the specific containers discussed herein are presented for purposes of illustration only and the invention is accordingly not meant to be limited thereto.

Each letter supply means contains a number of letter selections equal to that of the other. In a preferred embodiment, both the first and the second letter supply means contain fifty possible selections, which include the twenty-six letters of the alphabet, as well as multiple selections of particular letters, and in some instances, non-letter selections. The distribution of letters and of such letter selections varies between the letter supply means, and, in a preferred embodiment, each letter supply is provided with a letter distribution as set forth in the following tables.

TABLE 1

LETTER DISTRIBUTION OF FIRST LETTER SUPPLY

| LETTER | NUMBER AVAILABLE | LETTER | NUMBER AVAILABLE |
|---|---|---|---|
| A | 3 | N | 1 |
| B | 2 | O | 1 |
| C | 5 | P | 4 |
| D | 2 | Q | 1 |
| E | 1 | R | 2 |
| F | 2 | S | 5 |
| G | 1 | T | 3 |
| H | 1 | U | 2 |
| I | 2 | V | 1 |
| J | 1 | W | 2 |
| K | 1 | X | 1 |
| L | 1 | Y | 1 |
| M | 3 | Z | 1 |
| | | BLANK | 0 |

TABLE 2

LETTER DISTRIBUTION OF SECOND LETTER SUPPLY

| LETTER | NUMBER AVAILABLE | LETTER | NUMBER AVAILABLE |
|---|---|---|---|
| A | 2 | N | 2 |
| B | 2 | O | 2 |
| C | 2 | P | 2 |
| D | 2 | Q | 1 |
| E | 2 | R | 2 |
| F | 2 | S | 2 |
| G | 2 | T | 2 |
| H | 2 | U | 2 |
| I | 2 | V | 2 |
| J | 1 | W | 2 |
| K | 2 | X | 1 |
| L | 2 | Y | 2 |
| M | 2 | Z | 1 |
| | | BLANK | 2 |

The foregoing distribution is presented for purposes of illustration, as a statistically wide variety of distributions may be selected and employed within the scope of this invention.

Each of the letters of the alphabet is provided with a specific point value to enable the formation of words by the players to be scored and compared. Referring now to FIG. 1, a typical score sheet is shown which recites near the top thereof the specific point values assigned to each of the letters of the alphabet. Further, in the instance where the letter selections are provided on blocks or tiles, as described earlier, each of the blocks or tiles displays both the letter selected and its corresponding point value.

Referring further to FIG. 1, the scoring sheet of the present invention possesses a tabular format. The farthest left-hand column defines the turns taken by each player. The column to the immediate right, labeled "WORD," provides the space within which the letters may be placed as they are selected by the player, as will be described later on. The individual line segments are provided to correspond with the number of letters that may be employed to form the word. Although eight line segments are illustrated, the invention is not limited strictly thereto, and the scoring sheet may display a larger number of segments to accommodate larger words.

Referring yet further to FIG. 1, the column entitled "LETTER SCORE" is provided to display the numerical values of each of the letters selected and utilized by the player during each turn. Line segments are provided in numbers corresponding to those of the segments provided in the "WORD" column. The column to the immediate right, entitled "WORD SCORE," is provided to display the total point values agreed upon by the players, for the word formed by the player taking that turn. In most instances, this may comprise the totalling of the point values for each of the letters of the word, however, in the instance where the word is formed from eight letters, the simple numerical total is doubled and this resulting figure comprises the word score.

The final right-hand column entitled "TOTAL SCORE" simply records the total numerical score achieved by that player for the one or more turns comprising the game.

The scoring sheet of this invention would be provided in pad form for large scale distribution and sale in kit form, and individual sheets would thus be distributed to each player before the start of each game.

Figure 4:
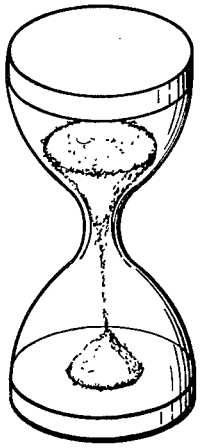
FIG. 4 is a perspective view illustrating the timing means of the invention.

In the instance where the game is to be played with a time limitation, as hereinafter described, the game apparatus may include a timer, such as an hour glass-type egg timer (see FIG. 4) or the like. The particular timing device is not critical, and may vary depending upon the range of time limits that one may desire to set. The provision of a time limitation on the action of a player during each turn tends to increase the difficulty of the game, and thereby enhances the challenge and excitement enjoyed by the players.

The present word forming game has as its primary objective for each player to create a word from the first three letters given, two of which are randomly provided and the third specifically selected by the player from the alphabet. The game is adapted to be played by one or more players and is especially suitable for participation by two to six players at a time. The game is played in accordance with the following sequence.

Initially, each player obtains a scoring sheet of the type set forth in the figure, discussed above. The player then places his or her name in the space provided.

Any player may commence the game, and once the game starts the rotation of turns taken follows a clockwise direction. A complete round, as defined herein, takes place when all of the participating players have had the opportunity to form an individual word.

Each player's turn proceeds as follows: the player first obtains the first random letter, which first random letter and its corresponding point value are recorded on the scoring sheet in the appropriate locations, discussed above. After the recording of the first random letter, the player then enters a particular letter of his or her choosing selected from the alphabet and thereby independent of the above described letter supplies. The selection of this second letter directly from the alphabet should be made carefully and in coordination with the first random letter received, as it will substantially affect the ability of the player to form a complete word upon receiving the second random letter. Thus, for example, should the first random letter be a "Q," the player would be prudent in selecting the letter "U" directly from the alphabet, as the likelihood of creating a valid word from this letter combination would be enhanced regardless of the identity of the second random letter received. Particularly in the instance where the present game is played with a time limitation imposed upon each turn, it is critical that the player be capable of forming a valid word in the shortest possible time. A general rule to follow is that a vowel should be selected in the instance where the first random letter is a consonant.

The second letter directly selected from the alphabet is recorded in the same manner as the first random letter received. The point value of this second letter may be derived from the chart provided on the score pad. The player then proceeds to obtain the third letter, comprising the second random letter provided by the second letter supply means. Like the previous letters, this second random letter is duly recorded both as to its identity and its corresponding point value.

At this point, the player may complete the turn by utilizing the three letters thus obtained to form a valid word, or may optionally select letters directly from the alphabet to form a longer word. In the instance where the game is played with a time limitation, the timer device described above is activated upon the completed selection of the second random letter, and the player is thereafter required within a given time period to complete the formation of a word.

The formation of the word may be made with any number of letters, and the invention is not specifically limited to the provision of a particular maximum number of letters. Three letter words are permissible, when possible, but three letters comprise the minimum number any player may use to form a word. In a further embodiment of the invention, the game may be played with the rule that the formation of a word having eight letters entitles that player to receive a score double that of the raw numerical total of the letter value of the participating letters in that word. This rule provides an incentive for the player to expand the initial three letters to a suitable eight letter word, and in the instance where a timing device is employed, urges that player to do so in rapid fashion and thereby provides additional challenge and excitement to the game.

Upon the completion of the word, the numerical total of the points available is recorded under the "WORD SCORE" column, and the "TOTAL SCORE" column. This completes the turn for an individual player, and the next player in rotation then commences to repeat the foregoing sequence. A full round of the game is completed when each player has attempted to form one word, as stated above.

The game may be played with several variant limitations. Thus, and as noted above, a time limitation may be imposed upon each player during his or her turn so as to limit the time available to form the word after the first three letters are selected. Additionally, the game may be played with a predetermined point score defining the point at which the game has been won by a particular player. Alternately, the game may be played for a stated number of rounds, after which the player with the highest score is declared the winner. Naturally, each of these variants may have imposed thereon the additional time limitation to heighten excitement, and it is possible that the game may terminate with a tie rather than a declared winner.

Additional optional rules bear consideration herein. Specifically, players are permitted to increase the score or size of a word by the addition of the letter "S" thereto. Likewise, proper names can be considered to be valid words, if they can be found in a dictionary, and invalid words are scored zero for the players turn.

In addition to the above, further optional rules may be imposed as agreed upon by the players prior to the commencement of the game. In particular, in the instance where a time limit is imposed the time limit may vary from thirty seconds, to one minute or higher. In the instance where a time limit is employed, a player not taking his or her turn will control the timer.

Further, with respect to the minimum score necessary to win the game, this score may be two hundred points, or such point accumulation as is agreed upon by the players before the commencement of the game. In a particular embodiment of the present game, the rules may include both a time limit of thirty seconds per turn, as well as a two hundred point winning total. As indicated earlier, these rules may be varied by the players upon agreement prior to the commencement of play and the present invention is not to be limited to a particular sequence of rules.

As noted earlier, the present invention contemplates the employment of a first and a second letter supply means which may be provided by either manual or electronic means. Particularly, the present description has proceeded with reference to the manual or mechanical embodiment of the letter supply means, comprising the containers each provided with a corresponding complement of letter tiles or blocks. In the instance where this mechanical embodiment is employed, the player selects the random letters by reaching into the container or bag, without looking, and selecting a particular letter. As noted earlier with reference to the letter selections, certain letter selections may be blank, in which case the player is entitled to select a letter from the alphabet in its place. After the letter is selected, and appropriately noted as described above, the letter is returned to the respective container and the container is then ready for use by the next player during that player's turn. Thus, each of the letter supply means comprises an individual container which is sequentially employed during a given player's turn.

In the instance where the letter supply means comprises an electronic supply means, such an electronic supply means may comprise a computer of the variety presently commercially available for home use, which has the capacity to store in its memory such information as is set forth in Tables 1 and 2, earlier. Further, such a computer would be capable of selectively retrieving letters from each of the separate letter supplies in the sequence desired, and the game would proceed upon request by the player to the computer to provide a random letter selection. The manner in which the information is stored in the memory of the computer would permit the selection of the respective letters out of each letter supply means to be sufficiently random as to conform to the mode of operation and objects of this game. The computer can be adapted automatically to provide score totals. The remainder of the game as described above proceeds identically in both instances, whether manual or electronic letter supplies are employed.

It is to be understood that the invention is not limited to the illustrations described and shown herein, which are deemed to be merely illustrative of the best mode of carrying out the invention, and which are susceptible of modifications of form, size, arrangement of parts and details of operation. The invention rather is intended to encompass all such modifications which are within the spirit and scope and defined by the claims.

What is claimed is:

1. A word forming game apparatus comprising a first letter supply means and a second letter supply means, each of said first and second letter supply means providing a plurality of letter selections, each letter selection being greater in number than a full complement of the letters of the alphabet, said first letter supply means having a letter distribution different from that of said second letter supply means, and said first and second letter supply means being adapted to be utilized serially and apart from each other for the respective selection of a first and a second random letter to be used in a word forming capacity, together with a letter selected directly from said alphabet sequentially intermediate thereto, said randomly selected letters and said directly selected letters all having assigned thereto certain numerical point values for scoring purposes, and means to permit the orderly and contiguous recordation of the letters selected, the words formed, and the point scores achieved thereby.

2. The game apparatus of claim 1 wherein each letter supply means provides fifty letter selections.

3. The game apparatus of claim 1 wherein only one of said letter selections includes one or more non-letter selections.

4. The game apparatus of claim 2 wherein said letter selections include a letter distribution defined by plural numbers of certain of said letters differs from the letter distribution of said second letter supply.

5. The game apparatus of claim 4 wherein the letter distribution of first letter supply means is A=3, B=2, C=5, D=2, E=1, F=2, G=1, H=1, I=2, J=1, K=1, L=1, M=3, N=1, O=1, P=4, Q=1, R=2, S=5, T=3, U=2, V=1, W=2, X=1, Y=1, and Z=1 and the letter distribution of said second letter supply means is A=2, B=2, C=2, D=2, E=2, F=2, G=2, H=2, I=2, J=1, K=2, L=2, M=2, N=2, O=2, P=2, Q=1, R=2, S=2, T=2, U=2, V=2, W=2, X=1, Y=2, Z=1, and BLANK=2.

6. The game apparatus of claim 1 wherein the numerical scoring values of said randomly selected letters and said directly selected letters are A=1, B=2, C=2, D=2, E=1, F=2, G=5, H=4, I=1, J=6, K=6, L=4, M=2, N=3, O=1, P=2, Q=9, R=2, S=2, T=2, U=1, V=7, W=8, X=9, Y=3, Z=9.

7. The game apparatus of claim 1 and further including means to limit the time available to each player to complete the formation of said word.

8. The game apparatus of claim 1 wherein said first and second letter supply means each comprises separate containers having disposed therein a plurality of separate tiles, said tiles displaying said letters and said numerical point values on at least one surface thereof.

9. The game apparatus of claim 8 wherein said containers comprise flexible bags.

10. The game apparatus of claim 8 wherein said first letter supply is provided with coloration different from that of said second letter supply.

11. The game apparatus of claim 1 wherein said first and second letter supply means each comprises separate data inputs disposed in a program retrievably stored within the memory of an electronic computer apparatus.

* * * * *